US009278377B2

(12) United States Patent
Brumback et al.

(10) Patent No.: US 9,278,377 B2
(45) Date of Patent: Mar. 8, 2016

(54) SYSTEM AND METHOD FOR SENSOR-BASED FEEDBACK CONTROL OF A SEED CONDITIONING AND PRODUCTION PROCESS

(75) Inventors: Thomas B. Brumback, Alleman, IA (US); Steven J. Corak, Raleigh, NC (US); James L. Hunter, Littleton, CO (US); Yong G. Lee, Johnston, IA (US)

(73) Assignee: PIONEER HI BRED INTERNATIONAL INC, Johnston, IA (US)

( * ) Notice: Subject to any disclaimer, the term of this patent is extended or adjusted under 35 U.S.C. 154(b) by 382 days.

(21) Appl. No.: 13/289,846

(22) Filed: Nov. 4, 2011

(65) Prior Publication Data

US 2012/0110954 A1 May 10, 2012

Related U.S. Application Data

(60) Provisional application No. 61/411,752, filed on Nov. 9, 2010.

(51) Int. Cl.

| | |
|---|---|
| ***B65B 1/04*** | (2006.01) |
| ***B65B 3/04*** | (2006.01) |
| ***B65B 57/00*** | (2006.01) |
| ***B65B 1/32*** | (2006.01) |

(Continued)

(52) U.S. Cl.

CPC ..... *B07C 5/00* (2013.01)

(58) Field of Classification Search

CPC ..... A01C 1/00; A01C 1/06; F26B 9/063; A01D 41/1276; A01F 11/06

USPC ..... 209/12.1, 509, 512, 529, 550, 551, 645, 209/659; 53/235, 502–504, 54, 52, 473, 53/467

See application file for complete search history.

(56) References Cited

U.S. PATENT DOCUMENTS 1,693,953 A * 12/1928 Kaspar ..... 99/609
5,176,573 A * 1/1993 Dow ..... 460/42

(Continued)

FOREIGN PATENT DOCUMENTS

FR 2 781 757 A1 2/2000

OTHER PUBLICATIONS

Veo™ Optical Sorter; Veo™ Green Ear Corn Sorter; Key Technology Automated Processing; Downloaded on Dec. 8, 2011 at http://www.key.net/products/veo-sorter/default.html.

(Continued)

*Primary Examiner* — Stephen F Gerrity
*Assistant Examiner* — Eyamindae Jallow

(57) ABSTRACT

A system and method are provided for optimizing the flow of seed along a seed handling path. The system and method include multiple stages at which seeds undergo different processes to prepare the seeds for sale or further handling. The stages may include one or more of Receiving, Husking, Sorting, Drying, Shelling, Bulk Storage, Sizing, Conditioning, Treating, and Packaging. Sensors may be located along the seed handling path for monitoring the seed handling path and the operations and conveyances occurring along the seed handling path at and between different stages. The sensors may provide feedback signals to a controller, which may in turn adjust the operating parameters of various processing devices associated with one or more of the stages in a real-time scenario to optimize the operations and conveyances occurring along the seed handling path.

7 Claims, 8 Drawing Sheets

(51) Int. Cl.
*B07C 5/00* (2006.01)
*B07C 5/16* (2006.01)

(56) References Cited

U.S. PATENT DOCUMENTS

| | | | | |
|---|---|---|---|---|
| 5,893,218 | A * | 4/1999 | Hunter et al. | 34/492 |
| 5,979,252 | A | 11/1999 | Precetti et al. | |
| 6,186,194 | B1 | 2/2001 | Poupon | |
| 6,706,989 | B2 | 3/2004 | Hunter et al. | |
| 6,747,461 | B2 | 6/2004 | Corak et al. | |
| 7,343,262 | B2 | 3/2008 | Baumgarten et al. | |
| 7,577,309 | B2 * | 8/2009 | Subbarao | 382/260 |
| 7,588,151 | B2 * | 9/2009 | Hunter et al. | 209/3.3 |
| 7,591,374 | B2 * | 9/2009 | Hunter et al. | 209/3.3 |
| 2005/0060958 | A1 | 3/2005 | Harmon et al. | |
| 2006/0285741 | A1 * | 12/2006 | Subbarao | 382/154 |
| 2007/0245906 | A1 | 10/2007 | Gorlitz | |
| 2008/0009962 | A1 | 1/2008 | Hood et al. | |
| 2009/0032441 | A1 | 2/2009 | Corak et al. | |
| 2010/0229421 | A1 * | 9/2010 | Salisbury | 34/524 |
| 2011/0079544 | A1 | 4/2011 | Hunter et al. | |
| 2013/0114861 | A1 * | 5/2013 | Takizawa | 382/106 |

OTHER PUBLICATIONS

Green Corn Eliminator; Magnuson Corporation; Vegetable, Fruit and Meat Processing Machinery by Magnuson Corporation; Downloaded on Jan. 11, 2010 at http://www.magnusoncorp.com/ccm3.htm.

Delta and Pine Land Co., says seed count packaging well-received [online] [retrieved Oct. 14, 2009]. Retrieved from the Internet: <URL: http://www.printthis.clickability.com/pt/cpt?action=cpt&title=Delta+ . . . >. 2 pages.

*Every Seed Counts, Optical Technology Counts Cotton Seeds and Improves Quality at Delta and Pine Land*, Seed Today, Second Quarter 2006, pp. 20-21.

International Search Report and Written Opinion from International Patent Application No. PCT/US2011/059286, mailed May 16, 2012.

International Preliminary Report and Written Opinion for Application No. PCT/US2011/059286, dated May 16, 2012.

U.S. Appl. No. 61/411,750, filed Nov. 9, 2010.

U.S. Appl. No. 61/420,095, filed Dec. 6, 2010.

* cited by examiner

SYSTEM AND METHOD FOR SENSOR-BASED FEEDBACK CONTROL OF A SEED CONDITIONING AND PRODUCTION PROCESS

CROSS-REFERENCE TO RELATED APPLICATIONS

The present application claims priority from U.S. Provisional Application No. 61/411,752 filed Nov. 9, 2010, which is hereby incorporated herein by reference in its entirety.

FIELD OF THE INVENTION

The present invention relates generally to systems and methods for optimizing seed handling processes in the production of seed. More specifically, the present invention provides a system and method for collecting data along a seed handling path, which may include steps relating to harvesting through packaging, and using the data to adjust the process parameters of the various steps in a real-time scenario.

BACKGROUND OF THE INVENTION

Commercial seed production is a process that involves many steps. In the case of corn, for example, harvested ears of corn may first be husked (i.e., have their husk material removed), sorted, dried, and shelled before the corn is placed into bulk storage. When it is time to package the seed corn, the seeds are removed from bulk storage, and they may be sized, conditioned, and/or treated before being packaged for sale or distribution.

Many factors can affect the quality of the end product seeds. For example, variations in the moisture content, ripeness, size, and quality of the harvested crop at the upstream end of the process may influence the effectiveness of each stage of the seed production process. As a result, there may be substantial variability in the end product, which is undesirable. Further, variations in the harvested crop may cause operating parameters such as feed rates to be adjusted in order to accommodate the variations. However, adjustments to an operating parameter at one step may result in undesirable effects downstream. For example, gravity tables may require a relatively consistent flow rate in order to function properly, and hence use of surge bins may be needed in order to equalize flow rates.

In some cases, some measurements are taken at a downstream location along the process through manual sampling of the seed, and the process upstream may be manually adjusted accordingly. Manual sampling, however, introduces an additional variable, as human errors may result in inaccurate information for process control. Furthermore, such manual sampling is typically isolated to one or two points along the process, which may not be enough to provide an accurate picture of the process conditions along the entire process path. In addition, such conventional sampling techniques are labor-intensive and may result in delays as the process is stopped to conduct the sampling and/or to make corresponding adjustments.

Further, manual sampling may not produce data at intervals sufficient to rapidly determine the existence of a statistically significant error. For example, when samples are taken at half hour increments, it may be hours before a sufficient number of data points are recorded and an error trend is identified. Further, during this time, seed product may continue to be produced and the defective seed product may combine with previously produced seed product. When the defective seed product is inseparable from the previously produced seed product, the continued production of defective seed product may contaminate additional seed and make it unusable.

Accordingly, there is a need in the art for an improved system and method of seed production which allows for more consistent and thorough measurements of process conditions and provides for adjustment of process parameters to optimize the quality of seed produced in an efficient and cost-effective manner.

BRIEF SUMMARY OF VARIOUS EMBODIMENTS

The present invention addresses the above needs and achieves other advantages by providing a system and method for optimizing the flow of seed along a seed handling path. In general, the system comprises a plurality of seed handling stages, wherein the plurality of seed handling stages is configured to process seed along a seed handling path, and wherein at least some of the seed handling stages along the seed handling path have one or more processing devices associated therewith, a plurality of sensors located along the seed handling path, and at least one controller in communication with the sensors and configured to control the processing devices. Each sensor is configured to provide a signal relating to a seed handling stage, and the controller is configured to make adjustments to one or more of the processing devices based at least in part on the signal provided by the sensor. In some embodiments, at least one of the plurality of seed handling stages is selected from the group consisting of a receiving stage, a husking stage, a sorting stage, a drying stage, a shelling stage, a bulk storage stage, a seed sizing stage, a seed conditioning stage, a seed treating stage, a seed packaging stage, and combinations thereof. In some embodiments, one of the plurality of seed handling stages comprises a receiving stage and another of the plurality of seed handling stages comprises a drying stage, and one of the plurality of sensors comprises a moisture sensor configured to provide a signal relating to a moisture level of seed received at the receiving stage, and the controller is configured to make adjustments to a processing device associated with the drying stage based at least in part on the signal provided by the moisture sensor. In some embodiments, one of the plurality of seed handling stages comprises a receiving stage and another of the plurality of seed handling stages comprises a husking stage, and one of the plurality of sensors comprises a husk deduction sensor configured to provide a signal relating to a weight of husklage per weight of seed received at the receiving stage, and the controller is configured to make adjustments to a processing device associated with the husking stage based at least in part on the signal provided by the husk deduction sensor. In some embodiments, the husking stage is an ear corn husking stage that includes a husking bed having at least one of a variable feed rate, a variable slope, or a variable drop point, and the husk deduction sensor is an ear corn husk deduction sensor configured to provide a signal relating to a weight of husklage per weight of ear corn, and the controller is configured to make adjustments to at least one of the feed rate, the slope, or the drop point of the husking bed based at least in part on the signal provided by the husk deduction sensor.

In some embodiments, one of the plurality of seed handling stages comprises an ear corn sorting stage and another of the plurality of seed handling stages comprises an ear corn husking stage that includes a husking bed, and one of the plurality of sensors comprises an ear corn sorter sensor configured to provide a signal relating to a degree of husking of ear corn at the ear corn sorting stage, and the controller is configured to make adjustments to the husking bed based at least in part on the signal provided by the ear corn sorter sensor. In some embodiments, one of the plurality of seed handling stages comprises an ear corn drying stage and another of the plurality of seed handling stages comprises a shelling stage, and one of the plurality of sensors comprises a moisture sensor configured to provide a signal relating to moisture of seed shelled at the shelling stage, and the controller is configured to make adjustments to a processing device associated with the ear corn drying stage based at least in part on the signal provided by the moisture sensor. In some embodiments, one of the plurality of seed handling stages comprises a bulk storage stage, one of the plurality of sensors comprises a bin moisture sensor configured to provide a signal relating to a moisture level of seed in a bulk storage bin of the bulk storage stage, and the controller is configured to make adjustments to a processing device associated with the bulk storage stage based at least in part on the signal provided by the bin moisture sensor. In some embodiments, one of the plurality of seed handling stages comprises a bulk storage stage, one of the plurality of sensors comprises a bin temperature sensor configured to provide a signal relating to a temperature of seed in a bulk storage bin of the bulk storage stage, and the controller is configured to make adjustments to a processing device associated with the bulk storage stage based at least in part on the signal provided by the bin temperature sensor. In some embodiments, the bulk storage stage includes an aerator, and the controller is configured to make adjustments to the aerator based at least in part on the signal provided by the bin moisture sensor. In some embodiments, the bulk storage stage includes an aerator, and the controller is configured to make adjustments to the aerator based at least in part on the signal provided by the bin temperature sensor.

In some embodiments, one of the plurality of seed handling stages comprises a seed conditioning stage, one of the plurality of sensors comprises a seed weight sensor configured to provide a signal relating to a weight of seed at the seed conditioning stage, and the controller is configured to make adjustments to a processing device associated with the seed conditioning stage based at least in part on the signal provided by the seed weight sensor. In some embodiments, one of the plurality of seed handling stages comprises a seed conditioning stage, one of the plurality of sensors comprises a seed count sensor configured to provide a signal relating to a seed count at the seed conditioning stage, and the controller is configured to make adjustments to a processing device associated with the seed conditioning stage based at least in part on the signal provided by the seed count sensor. In some embodiments, one of the plurality of seed handling stages comprises a seed conditioning stage, one of the plurality of sensors comprises a seed count sensor and another of the plurality of sensors comprises a seed weight sensor, and the seed count sensor and the seed weight sensor are configured to provide a signal relating to a seed count per weight, and the controller is configured to make adjustments to a processing device associated with the seed conditioning stage based at least in part on the signal provided by the seed count sensor and the seed weight sensor. In some embodiments, one of the plurality of seed handling stages comprises a seed packaging stage, one of the plurality of sensors comprises a seed count sensor and another of the plurality of sensors comprises a seed weight sensor, and the seed count sensor and the seed weight sensor are configured to provide a signal relating to a seed count per weight, and the controller is configured to make adjustments to a processing device associated with the seed packaging stage based at least in part on the signal provided by the seed count sensor and the seed weight sensor. In some embodiments, one of the plurality of stages comprises a seed treating stage, one of the plurality of sensors comprises a seed treatment uniformity sensor configured to provide a signal relating to treatment uniformity of seed at the seed treating stage, and the controller is configured to make adjustments to a processing device associated with the seed treating stage based at least in part on the signal provided by the seed treatment uniformity sensor. In some embodiments, one of the plurality of stages comprises a seed treating stage that includes a post-treatment dryer, one of the plurality of sensors comprises a moisture sensor configured to provide a signal relating to a level of moisture of the treated seed, and the controller is configured to make adjustments to the post-treatment dryer associated with the seed treating stage based at least in part on the signal provided by the moisture sensor. In some embodiments, one of the plurality of stages comprises a seed treating stage, one of the plurality of sensors comprises a seed treatment analysis sensor configured to provide a signal relating to at least one of a composition and a concentration of seed treatment, and the controller is configured to make adjustments to a processing device associated with the seed treating stage based at least in part on the signal provided by the seed treatment analysis sensor.

Another embodiment of the present invention provides a method for optimizing the flow of seed along a seed handling path. In general, the method comprises handling seed along a seed handling path comprising a plurality of seed handling stages, wherein at least some of the seed handling stages along the seed handling path have one or more processing devices associated therewith, providing signals via a plurality of sensors located along the seed handling path, each sensor being configured to provide a signal relating to a seed handling stage, and adjusting one or more of the processing devices via the controller based at least in part on the signal provided by one or more of the sensors. In some embodiments, one of the plurality of stages is selected from the group consisting of a receiving stage, a husking stage, a sorting stage, a drying stage, a shelling stage, a bulk storage stage, a seed sizing stage, a seed conditioning stage, a seed treating stage, a seed packaging stage, and combinations thereof. In some embodiments, the adjusting step comprises adjusting a processing device associated with an ear corn drying stage via the controller based at least in part on a signal from a moisture sensor that senses a moisture level of ear corn at an ear corn receiving stage. In some embodiments, the adjusting step comprises adjusting a processing device associated with an ear corn husking stage based at least in part on a signal from a husk deduction sensor that senses a weight of husklage per weight of ear corn at the ear corn husking stage. In some embodiments, the ear corn husking stage includes a husking bed having a variable feed rate and wherein the controller adjusts the feed rate of the husking bed based at least in part on the signal provided by the husk deduction sensor.

In some embodiments, the adjusting step comprises adjusting a processing device associated with an ear corn sorting stage based at least in part on a signal from an ear corn sorter sensor that senses a degree of husking of ear corn at the ear corn sorting stage. In some embodiments, the adjusting step comprises adjusting a processing device associated with an ear corn drying stage based at least in part on a signal from a moisture sensor that senses a moisture level of seed shelled at a shelling stage. In some embodiments, the adjusting step comprises adjusting a processing device associated with a bulk storage stage based at least in part on a signal from a bin moisture sensor that senses a moisture level of seed in a bulk storage bin of the bulk storage stage. In some embodiments, the adjusting step comprises adjusting an aerator of the bulk storage stage based at least in part on the signal provided by the bin moisture sensor. In some embodiments, the adjusting step comprises adjusting a processing device associated with a bulk storage stage based at least in part on a signal from a bin temperature sensor that senses seed temperature in a bulk storage bin of the bulk storage stage. In some embodiments, the adjusting step comprises adjusting an aerator of the bulk storage stage based at least in part on the signal provided by the bin temperature sensor. In some embodiments, the adjusting step comprises adjusting a processing device associated with a seed conditioning stage based at least in part on a signal from a seed weight sensor that senses a weight of seed at the seed conditioning stage. In some embodiments, the adjusting step comprises adjusting a processing device associated with a seed treating stage based at least in part on a signal from a seed uniformity sensor that senses treatment uniformity of seed at the seed treating stage. In some embodiments, the adjusting step comprises adjusting a processing device associated with a seed treating stage based at least in part on a signal from a moisture sensor that senses moisture of seed at the seed treating stage.

BRIEF DESCRIPTION OF THE DRAWINGS

Figure 1:
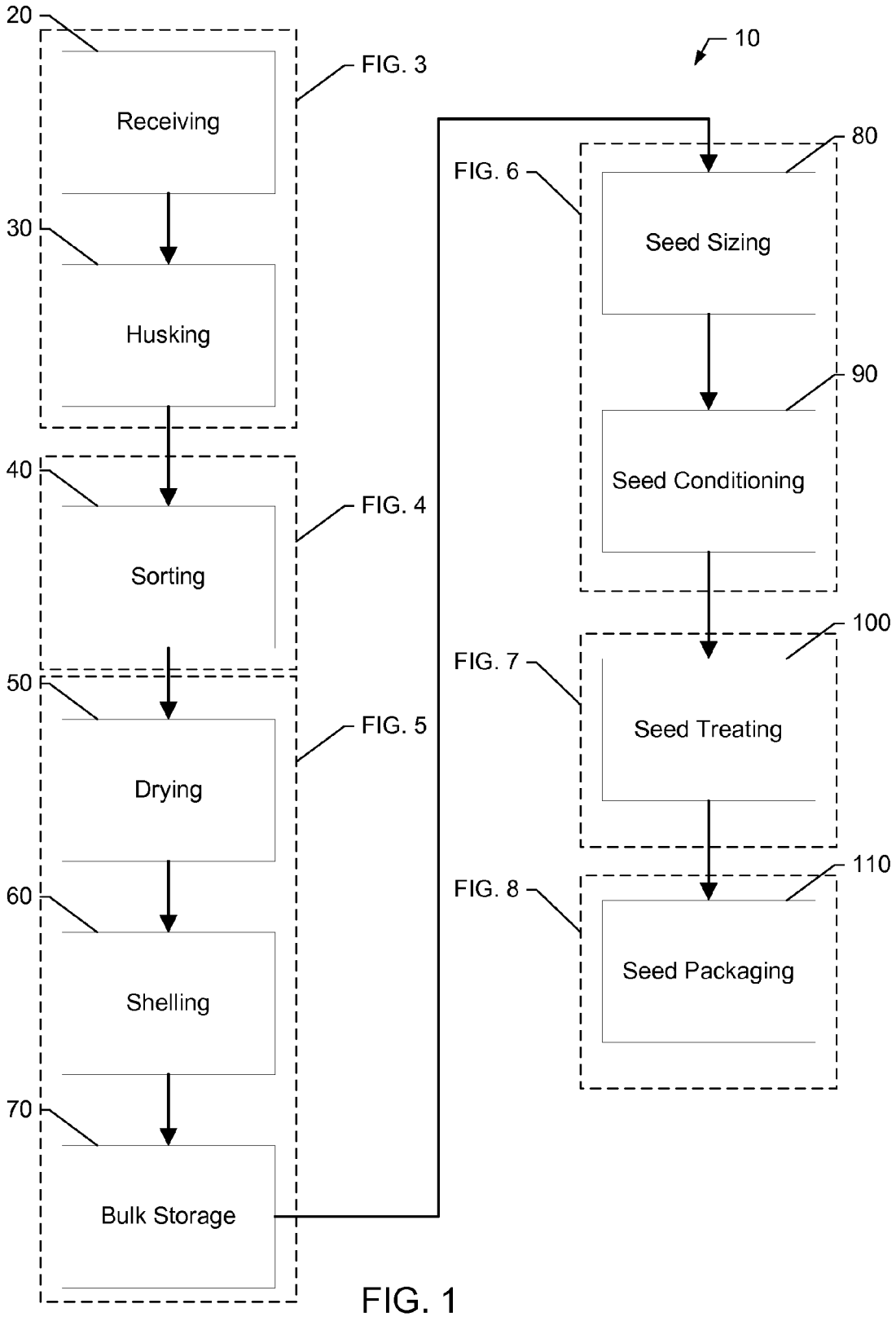
Figure 2:
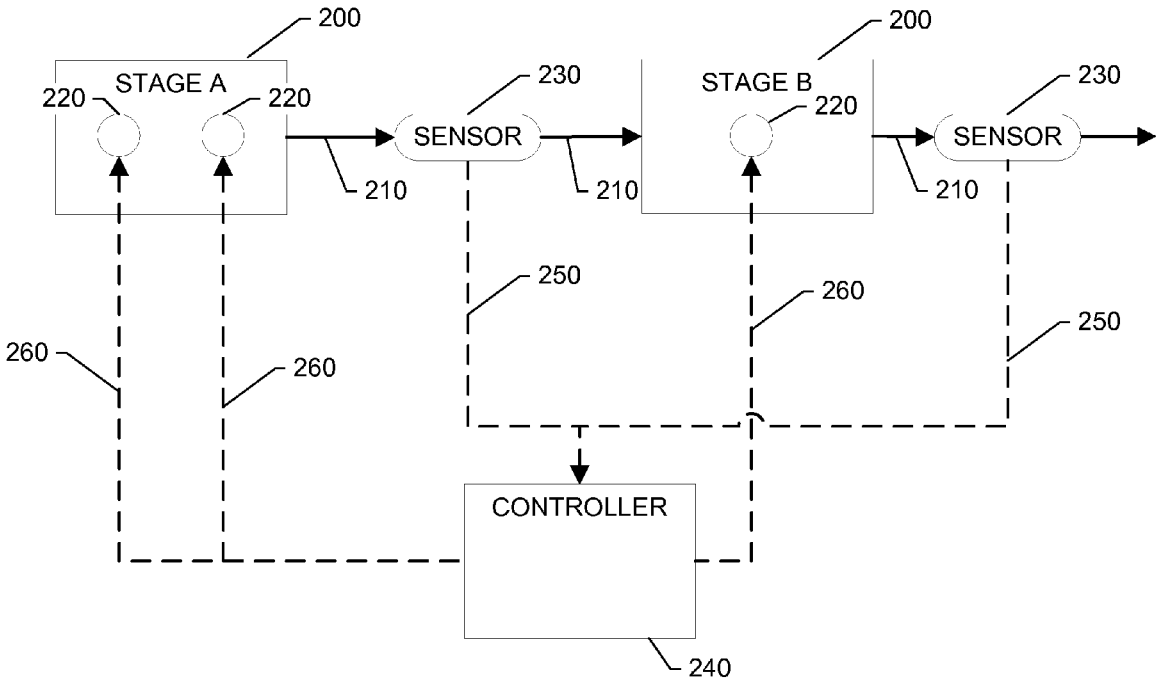
Figure 3:
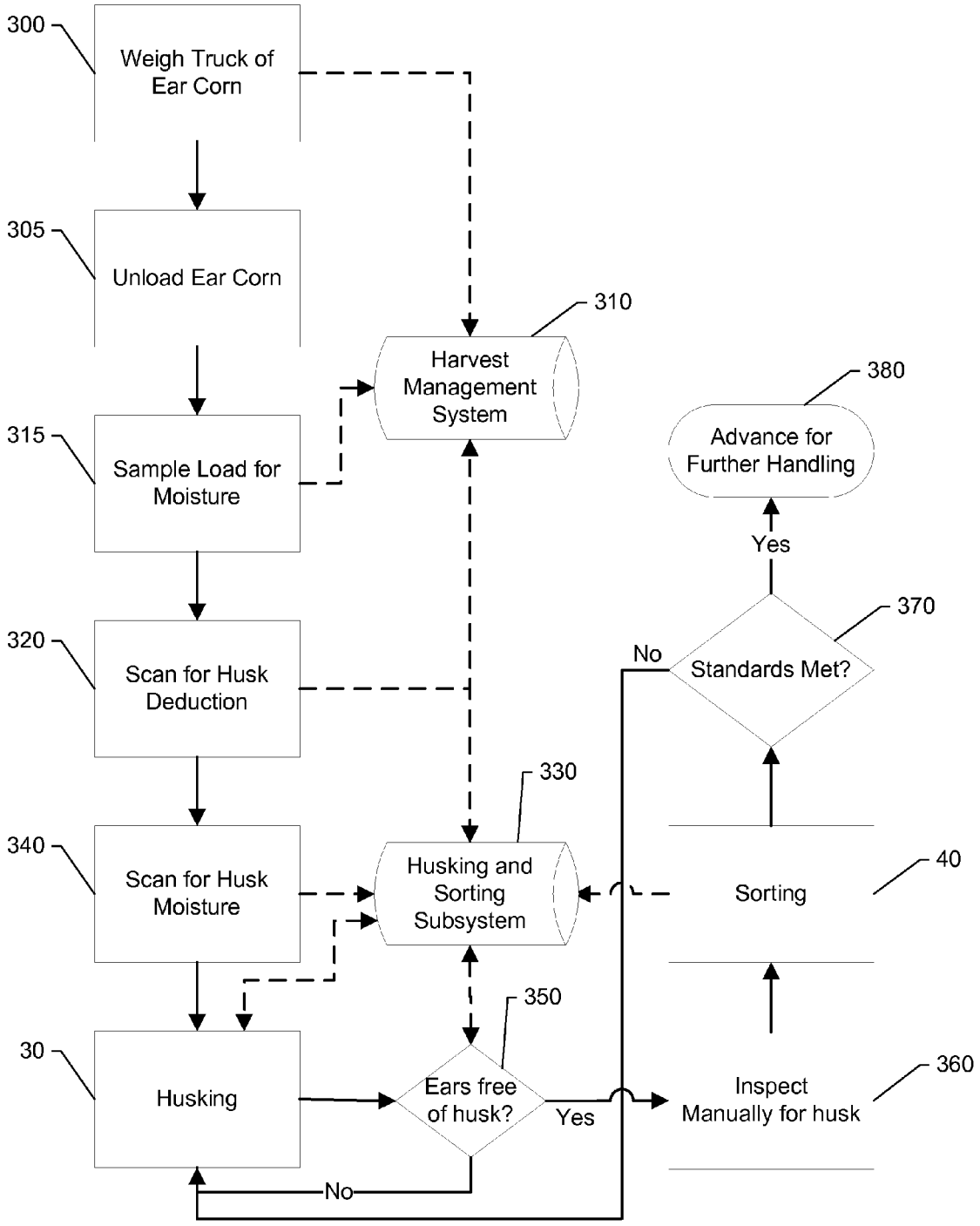
Figure 4:
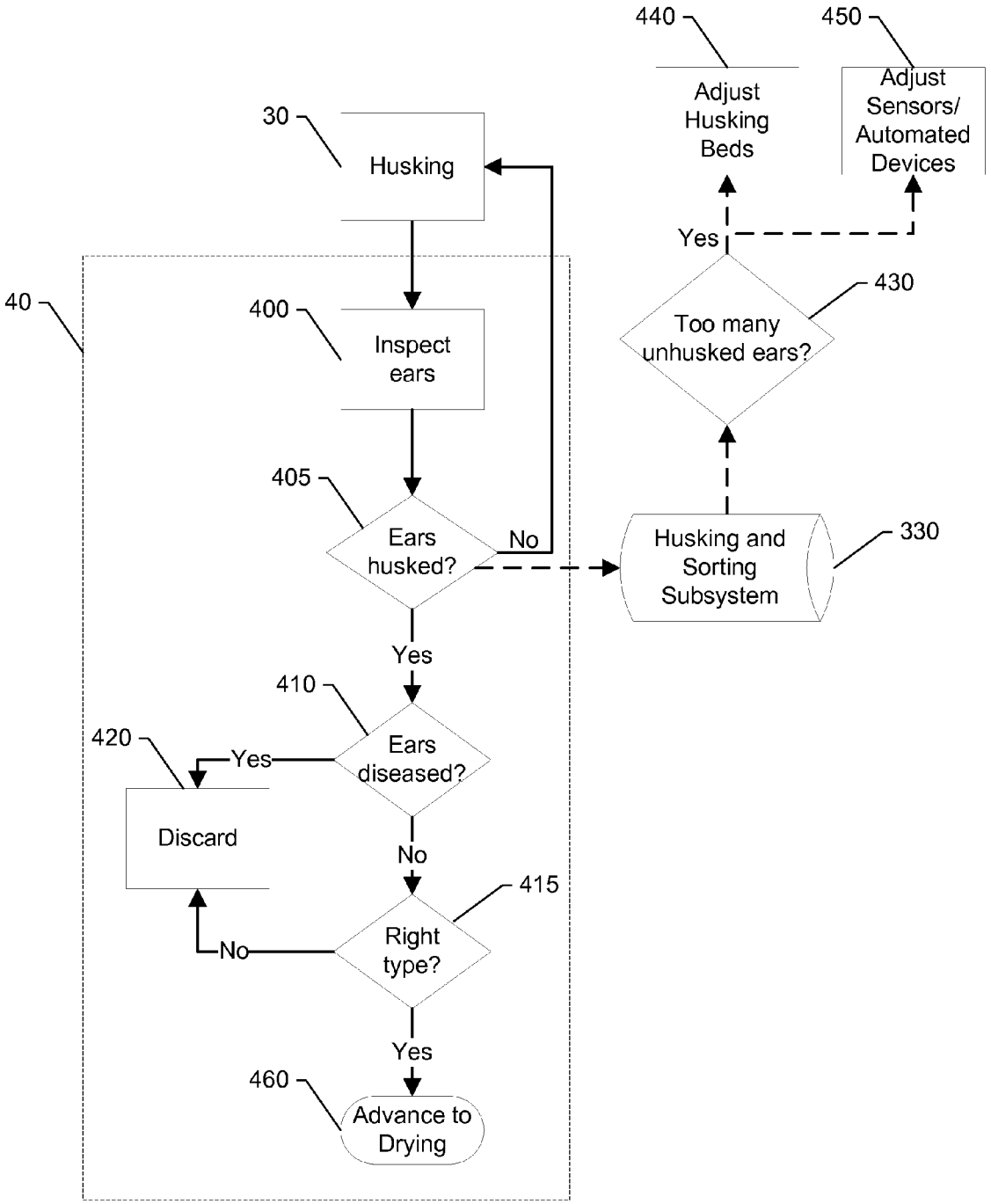
Figure 5:
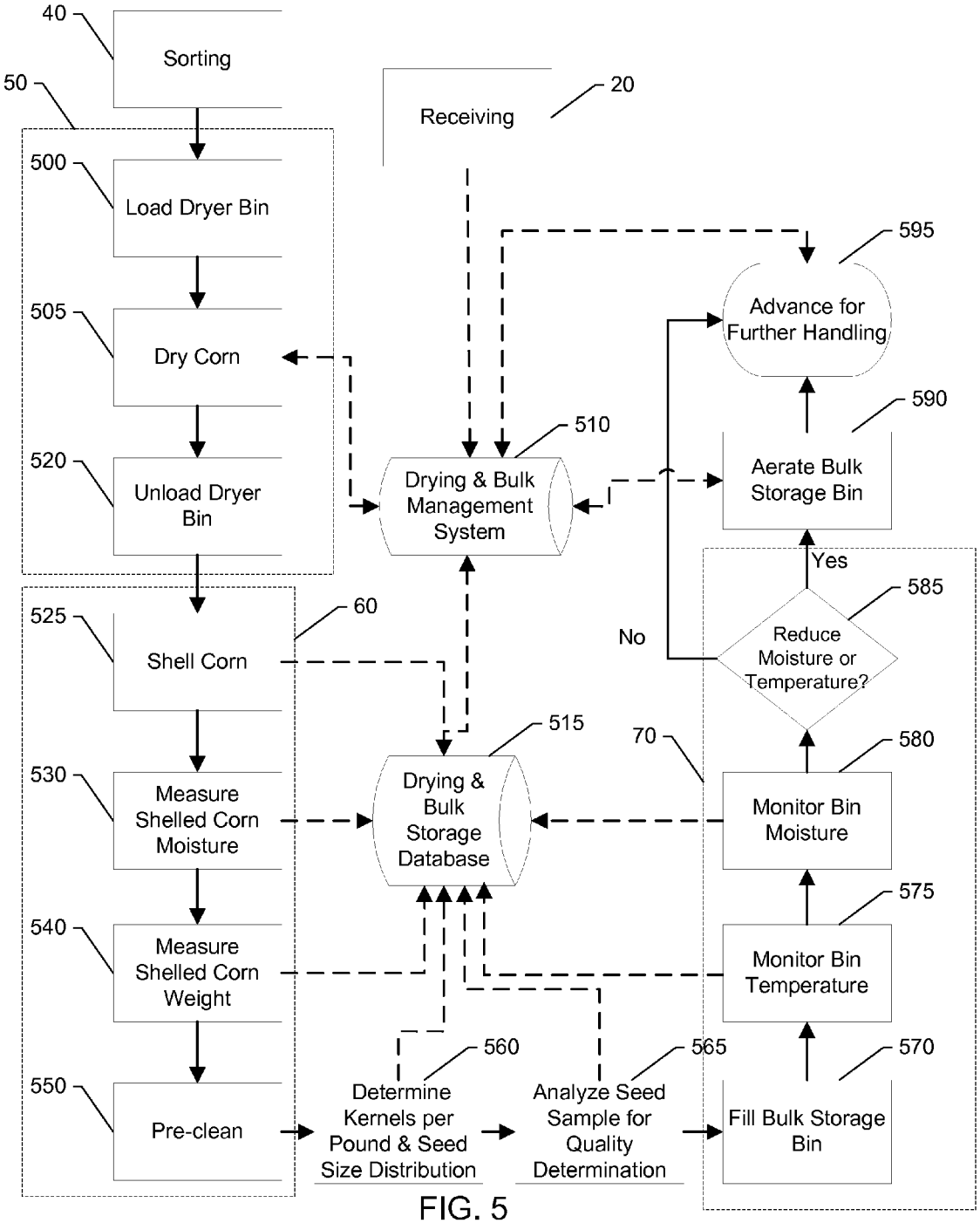
Figure 6:
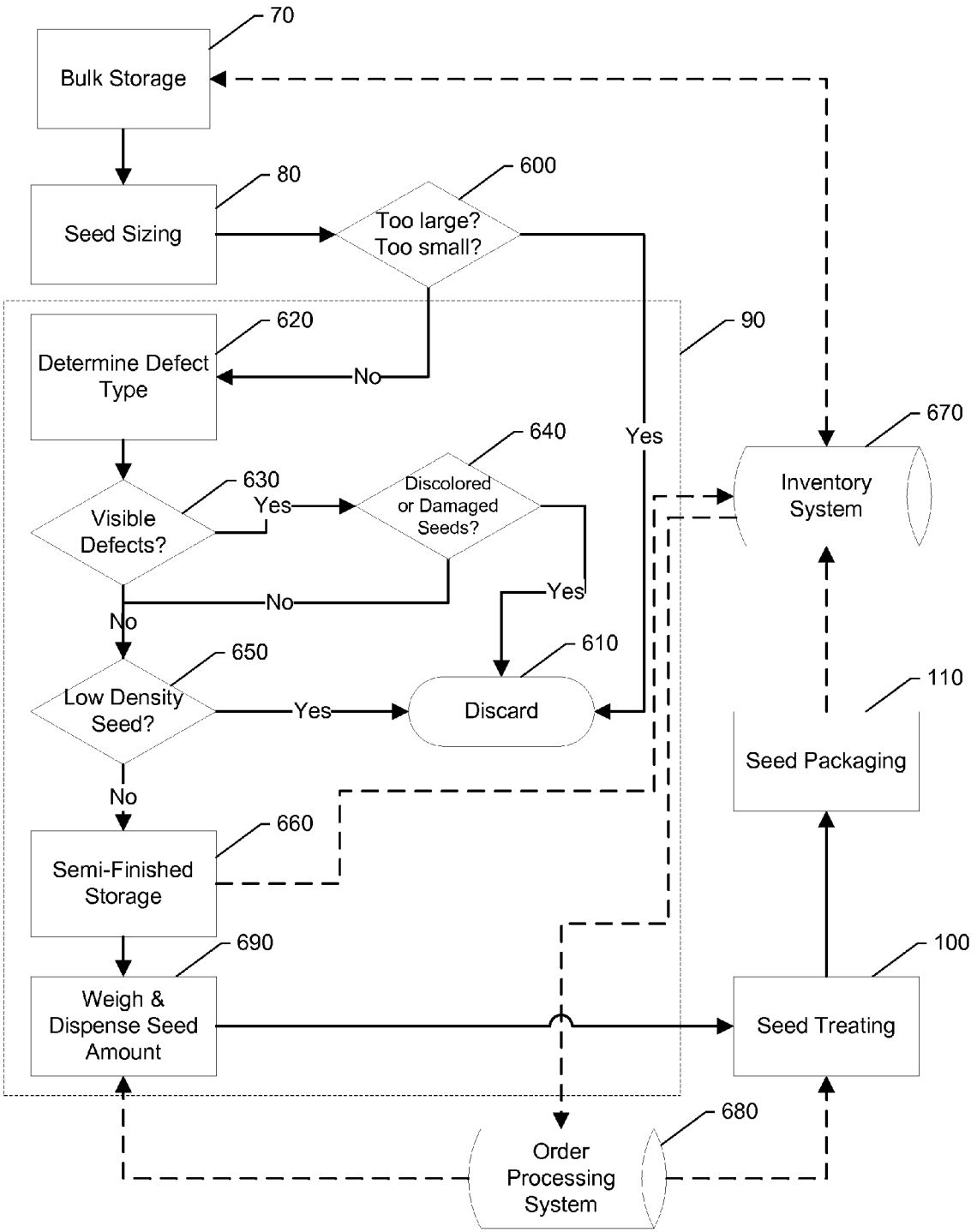
Figure 7:
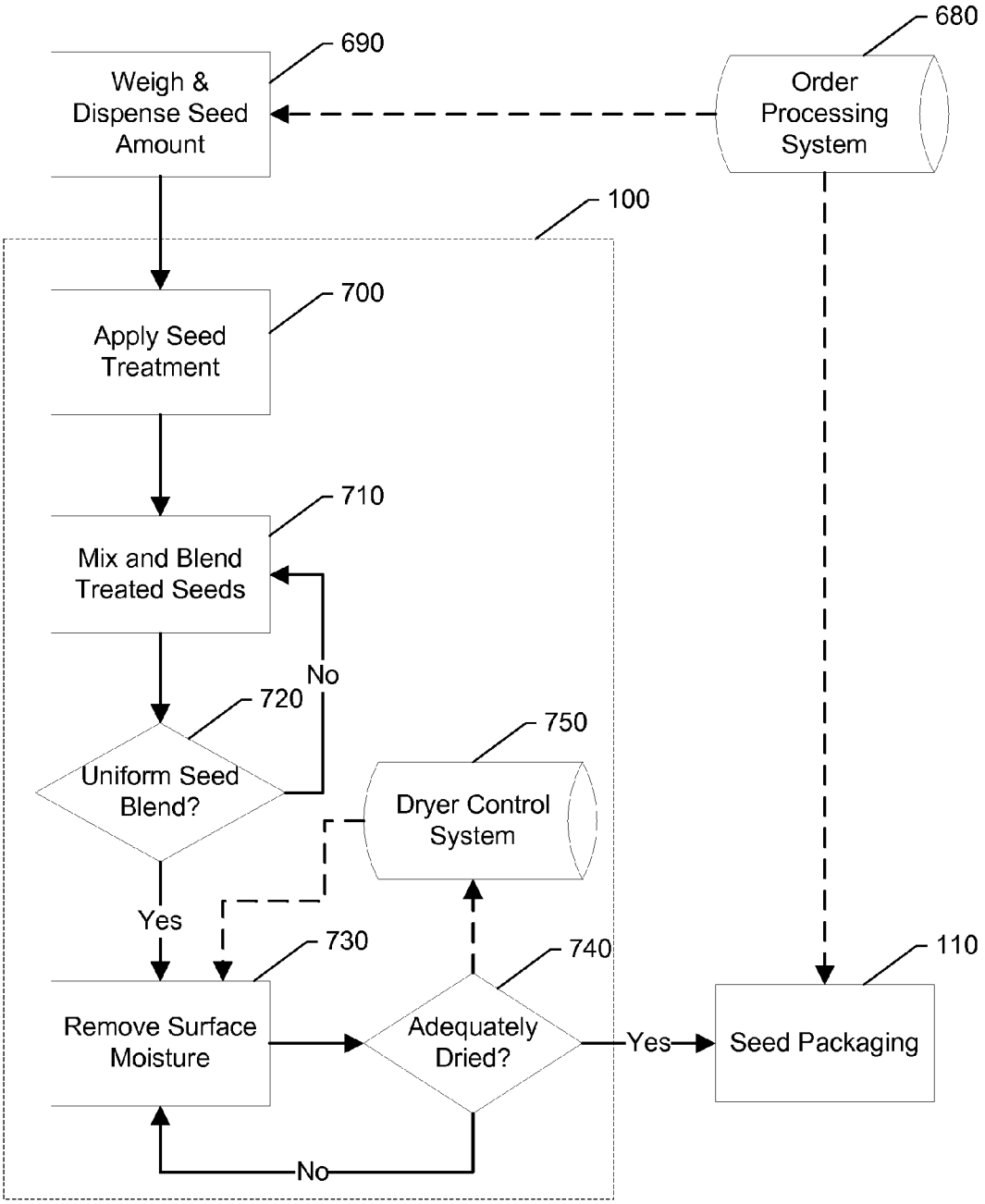
Figure 8:
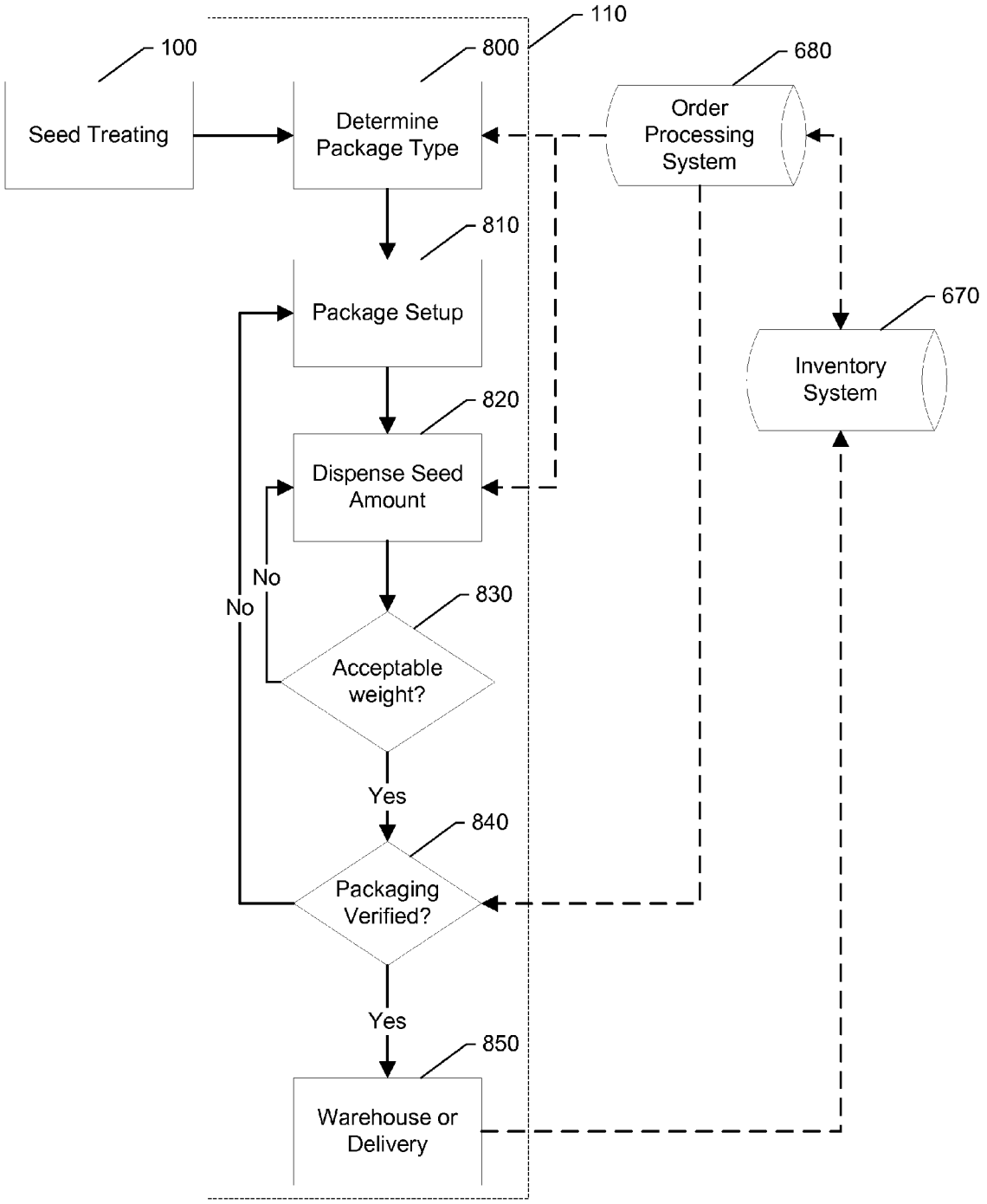

Having thus described the invention in general terms, reference will now be made to the accompanying drawings, which are not necessarily drawn to scale, and wherein:

FIG. 1 illustrates various seed handling stages for a system and method of optimizing the flow of seed along a seed handling path in accordance with an exemplary embodiment of the present invention;

FIG. 2 shows a schematic diagram of a system for optimizing the flow of seed along a seed handling path in accordance with an exemplary embodiment of the present invention;

FIG. 3 illustrates sub-processes of a Receiving stage and a Husking stage in accordance with an exemplary embodiment of the present invention;

FIG. 4 illustrates sub-processes of a Sorting stage in accordance with an exemplary embodiment of the present invention;

FIG. 5 illustrates sub-processes of a Drying stage, a Shelling stage, and a Bulk Storage stage in accordance with an exemplary embodiment of the present invention;

FIG. 6 illustrates sub-processes of a Seed Sizing stage and a Seed Conditioning stage in accordance with an exemplary embodiment of the present invention;

FIG. 7 illustrates sub-processes of a Seed Treating stage in accordance with an exemplary embodiment of the present invention; and FIG. 8 illustrates sub-processes of a Seed Packaging stage in accordance with an exemplary embodiment of the present invention.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

As will be described below, embodiments of the present invention are generally directed to a system and method for producing seeds. In various embodiments, the system and method include multiple stages at which seeds undergo different processes to prepare the seeds for sale or further handling. Taking corn as an example, seeds may be conveyed between stages configured for receiving, husking, sorting, drying, shelling, bulk storage, sizing, conditioning, treating, and packaging, as described in greater detail below. The description below refers to the handling of corn; however, one skilled in the art would recognize that the systems and methods described may be applied to other types of seeds, such as cotton seed, sunflower seed, grass seed, millet seed, vegetable seed, flower seed, soybean seed, alfalfa seed, wheat seed, sorghum seed, canola seed, and rice seed, among others. In addition, although particular stages are described, additional stages may be added, or stages may be removed, to adapt the system and method for producing an end product with different specifications or for handling other types of seeds, as necessary. In addition, the order of the handling stages may be changed to accommodate different types of seeds or according to user preferences.

As a result, embodiments of the present invention improve on the prior art by greatly reducing, and in some embodiments eliminating, the manual processes typically involved in handling seeds and preparing the seeds for sale, such as sample collection, sample analysis, machine or process adjustment, and repetition of the aforementioned steps in order to confirm implementation of appropriate adjustments. Therefore the present invention may decrease the time previously required for seed handling and the costs associated with performing manual sampling and equipment adjustments, while ensuring a more consistent end product.

Turning now to FIG. 1, a system 10 is shown for the handling of corn seed. Seed handling, as used herein, may refer to various operations conducted on seed as well as the conveyance thereof, which may occur along a seed handling path. In general, the system 10 includes multiple stages configured to harvest and stabilize the seed, as well as to size and condition the seed in preparation for sale to the end user. At a Receiving stage 20, raw product, such as unhusked ears of corn, is received from the field. In the case of corn, the raw product is then transported, such as via a conveyor belt or other automatic transporting mechanism, to a Husking stage 30, where the husk is removed from each ear of corn.

The husked ear corn is then moved to the Sorting stage 40, where undesirable ear corn (or other non-ear corn) is identified and removed from the handling path. Excess moisture is removed from the ear corn at the Drying stage 50, and the corn is shelled (i.e., removed from the cob) at the Shelling stage 60 before being conveyed to a Bulk Storage stage 70.

The seed may be kept in Bulk Storage 70 until the seed producer is ready to condition and package the seed. At that point, the seed may be moved to the Seed Sizing stage 80, where the seed is sampled, counted, and grouped according to the size and shape of the seed. The sized seed may then be conveyed to a Seed Conditioning stage 90, where seed conditioning is conducted. Seed conditioning may involve the process of removing seed that is damaged, diseased, the wrong genotype (e.g. as indicated by the wrong color), the wrong density (e.g. too low of density), too small or too large (e.g. tipping or scalping). Pre-germ seed which has begun to germinate, seed with a kernel red streak from mite damage to the pericap, or seed that has outcrossed to a hybrid with a different color than that which is dominant (e.g. yellow seed in white hybrids) are further examples of seed which may be removed. Seed conditioning may also involve removing inert material and/or weed seed. Note that some cleaning operations may occur before seed reaches Bulk Storage 70 and the Seed Sizing stage 80. Thus, in various orders of operation, the seed may be prepared for treatment at the Seed Treating stage 100. At the Seed Treating stage 100, for example, pesticide, herbicide, or other treatments may be applied to the seed. The treated seed can then be transported to the Seed Packaging stage 110, where the seed is packaged and labeled according to the seed's specific properties or characteristics for sale to the end user.

As the raw product/seed is conveyed from one stage to the next through the general system and process described above, certain parameters may need to be changed or adjusted to account for variations in the raw product/seed, environmental conditions, user preferences, or other factors. Rather than identify such factors manually, for example, by having a technician or line worker sample the seed at a certain point along the handling path, and then adjust the process manually, embodiments of the present invention provide for systems and methods of automatically sampling relevant parameters and automatically adjusting the system components based on the parameters and the desired end product.

With reference to FIG. 2 and as generally described above, embodiments of the present invention incorporate a number of seed handling stages 200, each configured to process seed along a seed handling path 210, with at least some of the seed handling stages having one or more processing devices 220 (which may be automated) associated with the particular seed handling stage. One or more sensors 230 may be located along the seed handling path 210, and at least one controller 240 may be provided. The controller 240 may be in communication with the sensors 230 and may be configured to control the various automated processing devices 220. The sensors 230 may thus be configured to provide a signal 250 to the controller 240 relating to a sensed parameter of the seed at the particular seed handling stage 200. The controller 240 may in turn be configured to make adjustments to one or more of the automated processing devices 220 based at least in part on the signal 250 provided by the sensor 230, such as via a control signal 260.

FIG. 3 shows in greater detail the processes that may be associated with the Receiving stage 20 and the Husking stage 30 of FIG. 1. In the case of ear corn, for example, green ear corn may be weighed 300 and unloaded 305 from a truck. The ear corn may be received, for example, in accordance with instructions maintained and/or issued by a Harvest Management System 310 that tracks the particular field or grower associated with a certain truckload of ear corn. In some instances, the ear corn may be sampled 315 to determine the moisture content of the corn, which may affect the adjustment of automated processing devices at downstream handling stages, such as the Drying stage 50, as described in greater detail below. The received ear corn may also be scanned, for example with a camera, as part of an automated husk deduction process 320. The husk deduction 320 may, for example, provide an estimate of the percentage of the total ear corn weight that is made up of the husklage, such as by estimating the weight of husklage per weight of ear corn. This data may be sent to the Harvest Management System 310 and used, for example, to calculate payment owed to the grower of the particular load of ear corn, as the grower may not be paid for excess husklage. In addition, the husk deduction information may be transmitted to a Husk and Sorting Subsystem 330, which may include a controller and/or processor configured to communicate with automated processing devices associated with upstream and downstream seed handling stages, as well as with other controllers and/or systems, such as the Harvest Management System 310. Thus, the Husk and Sorting Subsystem 330 may be configured to control and adjust the processes performed by automated processing devices at other handling stages based on the data sensed and received, for example, at the Receiving and/or Husking stages 20, 30, as described below.

In addition to husk deduction, the ear corn may be scanned for husk moisture 340, for example using Near Infra-Red (NIR) Reflectance. This data, too, may be transmitted to the Husk and Sorting Subsystem 330. For example, in some cases, the Husking stage 30 may include an automated husking bed having a variable feed rate, a variable slope, and/or a variable drop point. Thus, the Husk and Sorting Subsystem 330 may be configured to make adjustments to the feed rate, the slope, and/or the drop point of the automated husking bed based at least in part on the signal provided by the ear corn husk deduction sensor.

Changes in the slope, or pitch, of the bed, for example, may serve to adjust the residence time of the ear corn on the bed, depending on how difficult the husks are to remove. Feed rate may be adjusted along with the slope, such that if a greater slope is used (e.g., for more easily removed husks requiring a shorter residence time), the feed rate may be increased without flooding the bed with product. Alternatively, if the ear corn is determined to be green and husky based on the husk deduction 320, the slope of the automated husking bed may be decreased and the feed rate may be slowed down to optimize the husking of the ear corn and prevent overloading of the husking bed's capacity. Alternatively or in addition, the drop point of the ear corn onto the husking bed may be changed to allow for more aggressive husking of the green and husky ear corn. For example, the automated husking bed may be configured to have more aggressive husking devices upstream and less aggressive husking devices downstream. Thus, selecting the drop point to be in a more upstream location may allow the ear corn to be more aggressively husked, whereas selecting a downstream location may keep the corn kernels from being damaged from unnecessarily aggressive husking while still achieving optimum husking.

Once the ear corn has been husked, another sensor may be used to determine if the ear corn is free of husk at 350. If the sensor determines that husk remains on the ear corn, the corn may be conveyed back to the Husking stage 30 for further husking. If, on the other hand, the ear corn is substantially free of husk, according to the producer's standards, it may be advanced to the Sorting stage 40. In some embodiments, the husked ear corn may be manually inspected 360 for husk before advancing to the Sorting stage 40. Further quality control inspections may be imposed, for example as represented at 370, downstream of the Sorting stage 40, and seed failing to meet specifications may be transported back to the Husking stage 30 for further handling, as necessary, before advancing to downstream handling stages at 380.

At the Sorting stage 40, which is detailed in FIG. 4, additional sensors and devices may be used to determine whether the ear corn that has been received and husked is acceptable to be conveyed for further handling downstream. For example, ear corn conveyed from the Husking stage 30 may be inspected using sensors, such as vision-based sensors, at 400 to determine whether the ear corn has been acceptably husked 405, whether the ear corn is diseased 410, and/or whether the ear corn is the correct type of corn 415 (e.g., whether it is yellow corn or bi-color, etc.). This way, diseased corn, moldy corn, or non-corn articles (such as rocks or sticks), for example, may be discarded at 420, and corn that has not been properly husked can be transported back to the Husking stage 30, as discussed above. Further details regarding the sorting of ear corn may be found in U.S. Provisional Patent Application No. 61/411,750 entitled Methods and Systems for Sorting Ear Corn, which is incorporated by reference herein.

In addition, based on the feedback received from the sensors used in the Sorting stage 40, the Husk and Sorting Subsystem 330 may determine whether and how to adjust upstream automated processing devices, such as the husking beds, the robots and sensors involved in inspecting the husked corn, and other devices at 430, 440, and 450. Ear corn that has been sorted and found acceptable may then be advanced to the Drying stage 50.

Turning now to FIG. 5, sorted ear corn may be loaded into a dryer bin 500 and dried 505. Information regarding the initial moisture content of the ear corn, such as may have been gathered at the Receiving stage 20, may be transmitted to a Drying and Bulk Management System 510, which may be configured to communicate with and adjust the dryer at 505. The Drying and Bulk Management System 510 may, for example, include a controller and/or a processor and may also include or be in communication with a memory configured to store data regarding drying and bulk storage (e.g., memory on which a Drying & Bulk Storage Database 515 may reside). Other measurements, such as ambient air temperature and moisture content, may be sensed and relayed to the Drying & Bulk Management System 510, such as through the Drying & Bulk Storage Database 515, and may also be used by the Drying & Bulk Management System to adjust the operating parameters of the dryer at 505, such as the drying air temperature, airflow rate (and static pressure), percentage of time exposing the seed to up air (e.g. warm, less dry air) versus down air (e.g. hot dry air) in embodiments employing a two-pass drier, and/or the total duration of the drying. Further, in embodiments employing dryers with individual bin temperature and airflow controls, airflow and temperature may be changed as the moisture content of the seeds decreases.

Once the corn has been dried, it is unloaded from the dryer bin at 520 and conveyed to the Shelling stage 60. At the Shelling stage 60, the ear corn is shelled (e.g., the kernels are removed from the cob) at 525, and the moisture content of the shelled corn may be measured at 530 and communicated to the Drying & Bulk Storage Database 515 and/or the Drying & Bulk Management System 510. This information may further inform adjustments of the automated processing devices involved with the Drying stage 50 to obtain improved drying results. For example, an inline shelling moisture sensor may be employed to take readings at regular intervals (e.g. every fifteen (15) or thirty (30) seconds) and the readings may be plotted versus time to determine uniformity of drying within a bin. In this regard, high levels of variability in moisture readings may indicate that there are pockets of shelled corn restricting airflow through the ear corn. In such instances, the drying process may be extended or the airflow rate increased to reduce moisture stratification and reduce moisture levels.

In addition, the shelled corn may be weighed at 540, and the weight also transmitted to the Drying & Bulk Storage Database 515 and/or the Drying & Bulk Management System 510 for consideration in determining any dryer adjustments. Further details regarding monitoring moisture content can be found, for example, in U.S. Pat. No. 6,747,461 entitled Apparatus and Method for Monitoring Drying of an Agricultural Porous Medium Such as Grain or Seed, which is incorporated by reference herein.

The shelled corn may further be pre-cleaned at 550 (for example, to remove inert materials). As part of the pre-cleaning, the shelled corn may be scalped, checked, and aspirated. In addition, statistics such as the kernels per pound and seed size distribution may be obtained at 560, for example through machine vision technology. This information may be used, for example, to estimate seed supplies prior to completion of seed production. At this point, a sample of the corn may be analyzed to determine the quality of the seed at 565. Analyzing the sample of corn may involve monitoring the shelled corn to determine if a seed characteristic such as composition or color is out of tolerance using, for example, an inline sensor. Thereby, in some embodiments the sample of corn must be determined to meet the tolerances in order for the corn to be transported to the Bulk Storage stage 70. Again, the measurements with respect to the kernels per pound and the seed quality may be transmitted to the Drying & Bulk Storage Database 515 and/or the Drying & Bulk Management System 510, and this feedback may be used to adjust operating parameters at the Drying stage 50, as well as downstream at the Bulk Storage stage 70.

For example, the dried and shelled corn may be transported to a bulk storage bin at 570, where the seed will remain until it is needed, such as to fill a customer order. The temperature and moisture of the bulk storage bin may be monitored at 575 and 580, and the temperature and moisture data may be transmitted back to the Drying & Bulk Storage Database 515 and/or the Drying & Bulk Management System 510 as additional feedback. Again, this data may be considered by the Drying & Bulk Management System 510 in a determination of whether to reduce the moisture level or temperature of the bulk storage bin at 585, and based on the results, the bulk storage bin may be aerated at 590. Data regarding adjustments in aeration may be transmitted to the Drying & Bulk Storage Database 515 and/or the Drying & Bulk Management System 510 for further adjustments of the operating parameters of one or more of the automated processing devices. For example, an aerator may be configured to move air, heat air, dehumidify air, and/or cool air. Thus, if the data from the Drying & Bulk Storage Database 515 and/or the Drying & Bulk Management System 510 indicates that the bin is too warm, the aerator may be adjusted to provide cooler air; if the air is too moist, the ambient air may be dehumidified. In some cases, the air entering the bin may be cooled below the dew-point of the ambient air to remove moisture, then reheated to allow for drying of the stored seed. By properly aerating the bin, longer storage times may be achieved (for example, by avoiding the incursion of water vapor and localized problems with mold).

The seed may remain in Bulk Storage 70 for a certain length of time, according to user preferences and/or customer demands. Eventually, the seed may be advanced for further handling, as indicated at 595.

Turning now to FIG. 6, seed from Bulk Storage 70 is sized at 80 and conditioned at 90. In some embodiments, a seed size distribution may be developed by sampling the shelled corn, and this may occur between Bulk Storage 70 and Seed Sizing 80, or at Seed Sizing. Thereby, Seed Sizing 80 and Seed Conditioning 90 may be optimized using the seed distribution information. At the Seed Sizing stage 80, seeds (e.g., corn kernels) are separated into different groups according to size. Information regarding the number of seeds per unit weight may be used, for example, to adjust downstream process such as Seed Treating 100 and Seed Packaging 110. In some cases, it is helpful to determine the principle axes of each seed to generate a histogram of seed sizes and volumes. Such information may be used by the Inventory System 670 for optimizing estimates of usable supply and making adjustments to the various system components upstream to achieve a desired number of seeds per pound having a desired shape-size parameter. In addition, this type of data may be used as input for downstream analysis, such as in the identification of seed defects described below.

Once the seeds are sized, a determination may be made at 600 regarding whether certain seeds are either too large or too small for further handling. Seed that falls outside the acceptable range of sizes may, for example, be diseased or otherwise defective, or the seed may simply be unsuitable for the particular application for which the batch of seeds is being processed (e.g., not up to the seed producer's specifications). Accordingly, seed that is too large or too small may be discarded at 610. Further, the seed may be sorted by shape, with round seeds passing through round hole screens, and less round seed passing through slots.

In some cases, seed is further analyzed to determine whether there are any defects in, or damage to, the seeds at 620 as part of the Seed Conditioning stage 90. For example, seed may be conveyed through an apparatus that uses machine vision or laser to automatically determine whether there are any visible defects at 630, such as moldy or damaged kernels, or other defects such as an incorrect seed size, as previously discussed. If there are perceived defects, the potentially defective seed may be further analyzed at 640 to determine whether the seed is discolored or otherwise damaged, such as by using an automated precision color seed sorter, such as a SCANMASTER™ II Series color sorter available from Satake USA Incorporated of Stafford, Tex. If the seed is discolored or damaged, it may be discarded at 610. If not, the seed may be advanced to step 650, where the seed would be analyzed to identify and discard low density seed, as low density may be a further indication of a defective or otherwise unacceptable seed.

Seed that is deemed acceptable for further handling, or "semi-finished" seed, may then be advanced to semi-finished storage 660. The semi-finished seed may be imaged, such as using an imaging camera, to determine preliminary seed size distribution data, and the seed size distribution data may be transmitted to an Inventory System 670 configured to correlate the quantity and quality of seed being processed (i.e., actual supply) with the actual or estimated demand for different types of seed. Note that imaging may occur at the Seed Sizing stage 80 as opposed to at a later stage in some embodiments. The Inventory System 670 may also be in communication with automated processing devices involved in the Bulk Storage stage 70 and the Seed Packaging stage 110 and may further receive additional information regarding customer demands from an Order Processing System 680. Accordingly, feed rates and machine settings may be adjusted to provide target seed volumes which meet demand estimates for the seed. For example, smaller seed and round kernels may sell at a lower volume, and feed rates and machine settings may be adjusted based on this.

Based on information received from the Order Processing System 680, for example, seed stored in semi-finished storage 660 may be weighed and dispensed at 690 to fulfill customer demands. The dispensed seed may then be advanced to the Seed Treating stage 100 and the Seed Packaging stage 110, as depicted in FIG. 6. The Order Processing System 680 may further communicate with the automated processing devices of the Seed Treating stage 100 as described below to provide further estimates regarding the quantity and quality of seed required to satisfy estimated and/or actual customer orders.

Treated seed at 100 is then conveyed to the Seed Packaging stage 110 for further handling, as described in FIGS. 7 and 8, and the sensors involved in Seed Packaging stage 110 may provide further feedback to the Inventory System 670 regarding the actual quantity and quality of seed available for fulfilling customer orders.

As depicted in FIG. 7, after the seed is weighed and dispensed at 690 in accordance with the demand information received from the Order Processing System 680, the seed is transported to the Seed Treating stage 100. Various types of seed treatments may be applied at 700. For example, the seeds may be coated with different pesticide and/or herbicide treatments at different treatment rates according to customer demands. Seed treatments may also include nutrients and plant growth regulators in some embodiments. The seeds may be dried after application of a treatment. In addition, seeds treated with one type of seed treatment may be mixed and/or blended with seeds treated with another type of seed treatment at 710 according to customer demands and specifications. Alternatively, the seeds may be blended, and then treated and dried. Seed treatments and blending are described in greater detail, for example, in U.S. Provisional Patent Application No. 61/420,095, entitled System and Method for Combining, Packaging, and Separating Blended Seed Product, which is incorporated by reference herein. Further, in some embodiments the seeds which are to be blended may be treated with a chemical marker which allows the seeds to be separately identified (e.g. using non-visible light), if separation of the seeds may later be required, as discussed in U.S. Patent Application Publication No. 2011/0079544, filed on Oct. 1, 2009, entitled Method for Sorting Resistant Seed from a Mixture with Susceptible Seed, which is incorporated by reference herein. The blended seed may then be inspected for uniformity at 720, and batches that do not meet the standards for uniformity may be conveyed back to the mixing and blending apparatus.

Properly mixed and blended seed may then be advanced to an automated processing device for removing surface moisture at 730. For example, blowers and/or aerators may be used to dry the seed to ensure that the seed will be plantable when it arrives at the customer location. The seed may then be inspected for dryness at 740, and seed that has excess moisture may be sent back to have additional surface moisture removed. In addition, data regarding whether the seed is being adequately dried may be transmitted to a Dryer Control System 750, and based on the data received, the Dryer Control System may adjust the operating parameters of the automated processing devices at 730 to reduce the quantity of seed that needs to be sent back for additional moisture removal.

Treated, blended seed that meets the specifications for the amount of surface moisture may then be advanced to the Seed Packaging stage 110, which is detailed in FIG. 8. As part of the Seed Packaging stage 110, a package type may be determined at 800 based on the customer demand data received from the Order Processing System 680. For example, a particular customer may order a small package of seeds, such as a bag, or a larger delivery, such as a trailer load or other type of bulk delivery. The package required to fulfill the customer order may then be set up and prepared for receiving the seed at 810. The seed may then be dispensed at 820 in the amount specified by the customer demand information provided by the Order Processing System 680.

Before the packaged seed is delivered to the customer, the package may be weighed at 830 to verify that the desired seed weight or seed count is included in the package, based, for example, on a determined ratio of seeds per unit of weight. Thereby, the desired quantity and/or weight of seed in the package may be ensured.

Once the correct amount of seed has been packaged, a further check is done at 840 to verify that the package itself has been labeled correctly so as to accurately identify the type and quantity of the seeds. If the packaging is correct, the package is transported to a warehouse to await delivery to the customer or shipped directly to the customer at 850. Shipment to a warehouse or the customer may be tracked and relayed to the Inventory System 670, which may then update the system data regarding the inventory of seeds available for satisfying customer orders. In this regard, the Inventory System 670 may communicate changes in inventory to the Order Processing System 680 and may in turn receive updates from the Order Processing System, such that seed production at one or more of the stages described above may be adjusted in accordance with the rise and fall of seed supply and demand.

With the above process and system overview in mind, and turning again to FIGS. 1 and 2, a system 10 is provided for optimizing the flow of seed along a seed handling path. The system 10 may include a number of seed handling stages 200 that are configured to process seed along a seed handling path 210, and at least some of the stages may have one or more automated processing devices 220 associated with a respective stage. In addition, a number of sensors 230 may be located along the seed handling path 210, and the system 10 may include at least one controller 240 in communication with the sensors and configured to control the automated processing devices 220. Thus, each sensor 230 may be configured to provide a feedback signal 250 to the controller 240 relating to a seed handling stage 200, and the controller may in turn be configured to make adjustments to one or more of the automated processing devices 220 by transmitting a control signal 260 based at least in part on the feedback signal provided by the sensor.

Accordingly, as described above, a method is also provided for optimizing the flow of seed along a seed handling path. The method includes the steps of handling seed along a seed handling path comprising a number of seed handling stages and providing signals to a controller via a number of sensors located along the seed handling path. Each sensor may be configured to provide a signal relating to a seed handling stage, and at least some of the seed handling stages along the seed handling path may have one or more automated processing devices that are associated with respective seed handling stages. The method further includes adjusting one or more of the automated processing devices via the controller based at least in part on the signal provided by one or more of the sensors.

As noted above, various embodiments of the system and method may include different seed handling stages and combinations of seed handling stages. In addition, different types of sensors 230 at one or more of the seed handling stages may be used to provide feedback signals 250 to the controller 240, which may in turn transmit control signals 260 to one or more different automated processing devices 220 for optimizing the flow of seed along the seed handling path 210 based on the feedback signals.

For example, in some embodiments, the system 10 may include a Receiving stage 20 and a Drying stage 50, and one of the sensors 230 may include a moisture sensor that is configured to provide a signal 250 to the controller 240 relating to a moisture level of the seeds received at the Receiving stage 20. In this way, the controller 240 may be configured to make adjustments to an automated processing device 220 associated with the Drying stage 50, such as an aerator, based at least in part on the feedback signal 250 provided by the moisture sensor.

In other embodiments, the system 10 may include a Receiving stage 20 and a Husking stage 30, and one of the sensors 230 may include a husk deduction sensor that is configured to provide a signal 250 to the controller 240 relating to a weight of husklage per weight of seed received at the Receiving stage 20. The controller 240 may be configured to make adjustments to an automated processing device 220 associated with the Husking stage 30 based at least in part on the feedback signal 250 provided by the husk deduction sensor.

For example, when the seed being handled is corn and the Husking stage 30 is an Ear Corn Husking stage, the Ear Corn Husking stage may include an automated husking bed having a variable feed rate, a variable slope, and/or a variable drop point, as described above. Thus, the husk deduction sensor may be an ear corn husk deduction sensor that is configured to provide a signal relating to a weight of husklage per weight of ear corn, and the controller may be configured to make adjustments to the feed rate, the slope, and/or the drop point of the automated husking bed based at least in part on the feedback signal provided by the ear corn husk deduction sensor.

In still other embodiments, the system 10 may include a Sorting stage 40 that is an Ear Corn Sorting stage and a Husking stage 30 that is an Ear Corn Husking stage that includes an automated husking bed. In this case, one of the sensors 230 may include an ear corn sorter sensor that is configured to provide a feedback signal 250 to the controller 240 that relates to a degree of husking of the ear corn at the Ear Corn Sorting stage. The controller 240, in turn, may be configured to make adjustments to the automated husking bed (e.g., via a control signal 260) based at least in part on the signal 250 provided by the ear corn sorter sensor. For example, as described above, if the ear corn sorter sensor detects that the ear corn is not being properly husked at the Ear Corn Husking stage (i.e., an unacceptable amount of husklage is remaining on the ear corn after husking), the ear corn sorter sensor may provide a feedback signal 250 to the controller 240 to this effect, and the controller may transmit a control signal 260 to the automated husking bed to adjust the slope, feed rate, and/or drop point to obtain better husking results.

In some cases, the system 10 may include a Drying stage 50 that is an Ear Corn Drying stage and a Shelling stage 60. One of the sensors 230 may thus include a moisture sensor configured to provide a feedback signal 250 to the controller 240 relating to a level of moisture of the seed shelled at the Shelling stage 60, and the controller 240 may be configured to make adjustments to an automated processing device 220 associated with the Ear Corn Drying stage, such as an aerator, based at least in part on the signal 250 provided by the moisture sensor.

The system 10 in some embodiments may include a Bulk Storage stage 70, and one of the sensors 230 may include a bin moisture sensor that is configured to provide a signal 250 to the controller 240 relating to a moisture level of the seed in a bulk storage bin of the Bulk Storage stage. The controller 240 may thus be configured to make adjustments to an automated processing device 220, such as an aerator, that is associated with the Bulk Storage stage 70 based at least in part on the feedback signal 250 provided by the bin moisture sensor, for example by transmitting a control signal 260 to the aerator with particular operating parameters, as described in greater detail above.

In other embodiments, the system 10 may include a Bulk Storage stage 70, and one of the sensors 230 may include a bin temperature sensor that is configured to provide a signal 250 to the controller 240 relating to a temperature of the seed in a bulk storage bin of the Bulk Storage stage. The controller 240 may be configured to make adjustments to an automated processing device 220, such as an aerator that is capable of heating or cooling the air entering the bulk storage bin, based at least in part on the signal 250 provided by the bin temperature sensor.

The system 10 in some cases may include a Seed Conditioning stage 90, and one of the sensors 230 may include a seed weight sensor that is configured to provide a signal 250 to the controller 240 relating to a weight of seed at the Seed Conditioning stage 90. The controller 240 may in turn be configured to make adjustments to an automated processing device 220 associated with the Seed Conditioning stage 90 based at least in part on the signal 250 provided by the seed weight sensor. In addition or alternatively, one of the sensors 230 may include a seed count sensor that is configured to provide a signal 250 to the controller 240 relating to a seed count at the Seed Conditioning stage 90, and the controller may be configured to make adjustments to an automated processing device 220 associated with the Seed Conditioning stage 90 based at least in part on the signal provided by the seed count sensor. Thus, in cases where both a seed count sensor and a seed weight sensor are provided, these sensors are configured to provide a signal relating to a seed count per weight, and the controller 240 may be configured to make adjustments to the automated processing device 220 based at least in part on the signal provided by the seed count sensor and the seed weight sensor. For example, low test weight seed may be provided with lower airflow rates on gravity tables or during aspiration or, conversely, higher airflow rates may be used with higher test weight seed. Further, the seed count per weight may be used to determine the weight of seed which is later dispensed based on the desired seed count per package. Note that the various sensors 230 discussed herein may directly provide the signal to the controller 240 in some embodiments, whereas in other embodiments the outputted signal may be manually entered into the controller. For example, the signals may be outputted in the form of a displayed number, which may be entered into the controller 240 by an operator.

In still other embodiments, the system 10 may include a Seed Packaging stage 110, and one of the sensors 230 may include a seed weight sensor. The seed weight sensor in this case may be configured to provide a signal 250 to the controller 240 relating to weight, and the controller may be configured to make adjustments to an automated processing device 220 associated with the Seed Packaging stage 110 based at least in part on the signal provided by the seed weight sensor. For example, the weight of the package of seeds may be determined to ensure that the proper number of seeds is dispensed.

In some cases, the system 10 may include a Seed Treating stage 100, and the sensors 230 may include a seed treatment uniformity sensor that is configured to provide a signal 250 to the controller 240 relating to the treatment uniformity of the seed at the Seed Treating stage 100 (e.g., how uniformly the treatment is applied to each seed). A seed treatment uniformity sensor may in some embodiments comprise a vision sensor configured to determine the percentage of pixels in a seed mass that are above or below an intensity threshold. The sensors 230 may further include a seed treatment dosage sensor that is configured to provide a signal 250 to the controller 240 relating to the dosage of the seed treatment at the Seed Treating stage 100 (e.g. the treatment weight or volume of seed treatment material per weight of seed or the number of seeds treated). The controller 240 may be configured to make adjustments to an automated processing device 220 associated with the Seed Treating stage 100 based at least in part on the signal 250 provided by the seed treatment uniformity sensor and/or the seed treatment dosage sensor. Uneven coverage of the treatment, as indicated by larger variations in seed appearance, may be accounted for by increasing tumbling action in a polishing drum.

For example, the system 10 may include a Seed Treating stage 100 that includes an automated post-treatment dryer, and one of the sensors 230 may include a moisture sensor that is configured to provide a signal 250 to the controller 240 relating to a level of moisture of the treated seed. In some embodiments the moisture sensor may employ non-contact methods for measuring moisture. For example, the moisture sensor may comprise an infrared thermometer. In this regard, a seed with a wet surface may have a depressed surface temperature due to evaporation. In another embodiment near infrared reflectance may be used to measure surface wetness. In a further embodiment treated air could be directed past the seeds, and moisture on the seeds may be inferred by detecting changes to the flow of air indicative of energy loss due to evaporation. The controller 240 may be configured to make adjustments to the automated post-treatment dryer associated with the Seed Treating stage 100 based at least in part on the signal 250 provided by the moisture sensor.

As another example, the system 10 may include a Seed Treating stage 100, and one of the sensors 230 may be a seed treatment analysis sensor that is configured to provide a signal 250 to the controller 240 relating to a concentration and/or composition of the seed treatment. The controller 240 may be configured to make adjustments to an automated processing device associated with the Seed Treating stage 100 based at least in part on the signal 250 provided by the seed treatment analysis sensor. The seed treatment analysis sensor may in one embodiment be configured to detect near infrared wavelengths and absorbance peaks could be filtered to determine composition of the seed treatments, with the intensity of the signal relating to concentration of the different seed treatments.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for optimizing the flow of seed along a seed handling path, said system comprising:

a plurality of seed handling stages, wherein the plurality of seed handling stages is configured to process seed along a seed handling path, and wherein at least some of the seed handling stages along the seed handling path have one or more processing devices associated therewith;

a plurality of sensors located along the seed handling path; and at least one controller in communication with the sensors and configured to control the processing devices, wherein each sensor is configured to provide a signal relating to a characteristic of seed at a seed handling stage, and wherein the controller is configured to make adjustments to one or more of the processing devices based at least in part on the signal provided by the sensor and automatically optimizes the flow of seed along a seed handling path as a result of the signal received, wherein one of the plurality of seed handling stages comprises a seed treating stage, wherein one of the plurality of sensors comprises a seed treatment analysis sensor configured to provide a near infrared signal relating to at least one of a composition and a concentration of seed treatment, and wherein the controller is configured to make adjustments to a processing device associated with the seed treating stage based at least in part on the signal provided by the seed treatment analysis sensor.

2. The system of claim 1, wherein at least one of the plurality of seed handling stages is selected from the group consisting of:

a receiving stage;
a husking stage;
a sorting stage;
a drying stage;
a shelling stage;
a bulk storage stage;
a seed sizing stage;
a seed conditioning stage;
a seed treating stage;
a seed packaging stage; and
combinations thereof.

3. The system of claim 1, wherein one of the plurality of stages comprises a seed treating stage, wherein one of the plurality of sensors comprises a seed treatment uniformity sensor configured to provide a signal relating to treatment uniformity of a seed treatment at the seed treating stage, wherein the seed treatment uniformity sensor comprises a vision sensor, and wherein the controller is configured to make adjustments to a processing device associated with the seed treating stage based at least in part on the signal provided by the seed treatment uniformity sensor.

4. A system for optimizing the flow of seed along a seed handling path, said system comprising:

a plurality of seed handling stages, wherein at least one of the seed handling stages comprises a seed treating stage;

a plurality of sensors located along the seed handling path, wherein one of the plurality of sensors comprises a seed treatment uniformity sensor configured to provide a signal relating to at least one of a concentration or a composition of a seed treatment; and at least one controller in communication with the sensors and configured to make adjustments to one or more of the processing devices associated with the seed treating stage based at least in part on the signal relating to at least one of the concentration or the composition of the seed treatment.

5. The system of claim 4, wherein the seed treatment uniformity sensor comprises a vision sensor and is configured to determine the percentage of pixels in a seed mass that are above or below an intensity threshold.

6. The system of claim 4, wherein the seed treatment uniformity sensor is configured to provide a near infrared signal filtered to determine composition of the seed treatment, with the intensity of the signal relating to the concentration of the different seed treatments.

7. The system of claim 4, wherein seed treatment uniformity sensor comprises a non-contact moisture sensor relating to a level of moisture of the seed treatment applied to the seed, and wherein the controller is configured to make adjustments to an automated post treatment dryer associations with the seed treating stage.

* * * * *